US007504010B2

(12) United States Patent
Aune et al.

(10) Patent No.: US 7,504,010 B2
(45) Date of Patent: Mar. 17, 2009

(54) ANODE FOR ELECTROLYSIS OF ALUMINUM

(75) Inventors: Jan Arthur Aune, Ytre Enebakk (NO); Georg Frommeyer, Ekrath (DE); Kai Johansen, Kristiansand (NO); Donald R. Sadoway, Watertown, MA (US); Gro Soleng, Olso (NO); Elke William Thisted, Kristiansand (NO)

(73) Assignee: Elkem AS, Oslo (NO)

( * ) Notice: Subject to any disclaimer, the term of this patent is extended or adjusted under 35 U.S.C. 154(b) by 526 days.

(21) Appl. No.: 11/371,590

(22) Filed: Mar. 9, 2006

(65) Prior Publication Data

US 2007/0209944 A1 Sep. 13, 2007

(51) Int. Cl.
*C25B 11/02* (2006.01)

(52) U.S. Cl. ..... 204/293; 204/243.1; 204/247.3; 204/247.4; 204/280; 204/291; 204/292; 205/372; 205/380; 205/385

(58) Field of Classification Search ..... 204/243.1, 204/247.3, 247.4, 280, 291, 292, 293; 205/372, 205/380, 385
See application file for complete search history.

(56) References Cited

U.S. PATENT DOCUMENTS 4,338,177 A * 7/1982 Withers et al. ..... 204/247.3
4,347,083 A 8/1982 Sara
4,411,747 A * 10/1983 Dawless et al. ..... 205/377
4,670,110 A * 6/1987 Withers et al. ..... 205/362
5,254,232 A 10/1993 Sadoway
6,083,362 A 7/2000 Hryn et al.
6,395,423 B1 5/2002 Kawakami et al.
2003/0075454 A1 * 4/2003 Nora et al. ..... 205/380
2004/0011660 A1 * 1/2004 Bradford et al. ..... 205/385
2004/0011661 A1 * 1/2004 Bradford et al. ..... 205/385
2005/0199508 A1 9/2005 D'Astolto et al.

OTHER PUBLICATIONS

U.S. DOE 2 pages, Publication Date: Jul. 2001.

* cited by examiner

*Primary Examiner*—Bruce F Bell
(74) *Attorney, Agent, or Firm*—Lucas & Mercanti LLP

(57) ABSTRACT

The present invention relates to a dimensionally stable oxygen-evolving anode for use in an electrolytic cell for the production of aluminium. The anode comprises of a container made from an alloy comprising aluminium and at least one metal more noble than aluminium; a fluid bath in the bottom of the container having the ability to dissolve aluminium, said fluid having a density that is higher than the density of molten aluminium at the operating temperature of the cell, a pool of molten aluminium floating on top of the fluid bath in the bottom of the container; a refractory layer arranged on the inner sidewalls of the container at least in the area of the pool of molten aluminium, said refractory layer protecting the molten aluminium from contacting the inner sidewalls of the container.

20 Claims, 2 Drawing Sheets

ANODE FOR ELECTROLYSIS OF ALUMINUM

FIELD OF INVENTION

The present invention relates to an electrolytic cell for the production of aluminium, and more particularly to dimensionally stable oxygen-evolving anode for electrolytic production of aluminium.

BACKGROUND OF THE INVENTION

Electrolytic production of aluminium using the Hall-Héroult electrolytic process is well known. In the Hall-Héroult process aluminium is produced from $Al_2O_3$ dissolved in an electrolytic bath of molten cryolite and $AlF_3$ at a temperature of about 960° C. using carbon anodes. Aluminium ions are reduced to aluminium at the cathode while oxygen is combined with carbon at the anode to form $CO_2$ gas.

In this process about half a kilogram of carbon is consumed for each kilogram of produced aluminium. Carbon anodes must therefore routinely be replaced. The $CO_2$ gas produced at the anode is considered to be a green house gas, and is an undesired by product of the process.

Efforts have been made to provide inert and dimensional stable anodes for use in the electrolytic production of aluminium. Most of the research has concentrated in oxide-based ceramic anodes and cermet anodes. However, these efforts have so far not been commercialised for production of aluminium.

U.S. Pat. No. 5,254,232 describes an anode for use in molten electrolyses of metals such as aluminium. The anode comprises an alloy of the product metal such as aluminium and a more noble metal upon which is formed an oxide of the product metal as a protective layer. For electrolysis of aluminium the protective layer consists of $Al_2O_3$. All surfaces of the anode intended to be in contact with the electrolyte in the cell have this protective layer. The anode of U.S. Pat. No. 5,254,232 suffers from the disadvantages that the protective layer may be dissolved, particularly if the content of alumina in the electrolyte becomes low. Thus one has to operate the electrolytic cell with an electrolyte which is saturated with alumina. This can cause operational problems such as accumulation of undissolved alumina at the bottom of the electrolytic cell and will further provide problems in controlling the cell operation. If the protective layer of the anode is dissolved, the alloy of which the anode is made can be consumed resulting in failure of the anode.

U.S. Pat. No. 6,083,362 describes an anode for use in electrolytic production of aluminium, where the anode comprises a substrate made from a metal alloy defining a cavity where the substrate comprises an interior wall and an exterior surface where the substrate is capable of diffusing aluminium from the cavity to the exterior surface to provide a film covering portions of the exterior surface and mean for replenishing the film. The means for replenishing the film on the exterior surface of the substrate is a molten salt containing aluminium and an anion selected from the group consisting of a fluoride, a carbonate, a chloride, an oxide and combination of these.

The anode described in U.S. Pat. No. 6,083,362 has some disadvantages. The aluminium in the fluid salt composition is depleted as the aluminium diffuses through the substrate to the exterior surface. Thus, the concentration of aluminium in the salt varies and additional aluminium must be supplied to the molten salt in the cavity from time to time during the use of the anode to maintain the concentration of aluminium in the fluid molten salt bath in the cavity. Such periodic additions of aluminium to the salt is impractical in a commercial operation where the electrolytic cell is closed. Furthermore, variation in the aluminium content of the salt will cause variation in the composition and thickness of the protective layer and have a deleterious effect on the operation of the electrolytic cell. Finally as the aluminium content in the salt bath decreases it will be difficult to maintain a homogeneous concentration of aluminium in the salt bath. This may cause a too low aluminium activity locally in the salt bath resulting in a too low diffusion rate of aluminium through the metal alloy which may cause permanent changes locally in the metal alloy making it impossible to maintain the protective layer locally on the outside of metal alloy. It should be appreciated that no stirring device or other means for maintaining a homogeneous aluminium concentration in the salt bath is described in U.S. Pat. No. 6,083,362.

There is a need for commercial process for the production of aluminium using a dimensionally stable anode where the protective layer is stable.

DESCRIPTION OF INVENTION

It is an object of the present invention to provide a dimensionally stable, oxygen-evolving anode for use in electrolytic production of aluminium, where part of the anode in contact with the electrolyte has a protective layer that is self-replenishing, so as to maintain a stable protective layer on the outside of the anode.

An arrangement has been discovered that allows for a constant supply of aluminium to the anode. This constant supply of aluminium allows the process to be operated in a commercially feasible manner. The aluminium supply is provided from a molten bath of aluminium located inside the anode. This allows for the cell to be closed during operation without the need for supplying aluminium to the interior of the anode during operation of the cell.

Additionally, because there is a constant supply of aluminium to the anode, the concentration of aluminium in the anode and at the protective layer, is substantially constant. This stabilizes the protective layer on the outside of the anode and provides for more efficient operation of the anode and the electrolytic cell.

Furthermore, it has been found that a higher current density can advantageously be employed in the present invention. This high current density stabilizes the protective layer on the outside of anode. It has also been found that operating at a high current density results in an increased rate of production of the aluminium thereby improving the overall efficiency of the electrolytic cell.

The present invention thus relates to a dimensionally stable oxygen-evolving anode for use in electrolytic production of aluminium wherein the anode comprises a container made from an alloy containing aluminium and at least one metal more noble than aluminium; a fluid bath in the bottom of the container having the ability to dissolve aluminium, said fluid having a density that is higher than the density of molten aluminium at the operating temperature of the cell; a layer of molten aluminium floating on the fluid bath; a refractory layer arranged on the inner walls of the container at least in the area of the molten aluminium, said refractory layer protecting the side walls of the container from the molten aluminium and avoiding contact between the molten aluminium and the container.

The present invention also relates to a method for operating an anode in an electrolytic cell used in the manufacture of aluminium wherein the anode is in the form of a container and aluminium diffuses from inside the anode to outside the anode to form an aluminium oxide protective coating on the outside of the anode, said method characterized in that a fluid bath is provided in the bottom of the container, said bath having the ability to dissolve aluminium, said fluid having a density, at the operating temperature of the cell that is higher than the density of molten aluminium at the operating temperature of the cell; and a layer of molten aluminium is provided on top of the fluid in the container.

The present invention also relates to a method for operating an anode in an electrolytic cell used in the manufacture of aluminium wherein the anode is in the form of a container and aluminium diffuses from inside the anode to outside the anode to form an aluminium oxide protective coating on the outside of the anode, said method characterized in that electricity is provided to said anode at a maximum current density.

The alloy used to make the container, or hollow anode of the present invention, must withstand the operating temperature of the electrolytic bath. Suitably, the alloy can withstand a temperature of at least about 1000° C. More suitably, the alloy has a melting point above about 1000° C., thereby allowing it to withstand the operating temperature of the cell. Good results have been found with alloys that have melting points of about 1040° C.

The alloy used to make the container must conduct electricity.

The alloy used to make the container allows for diffusion of aluminium from inside the anode to outside the anode.

The aluminium from the molten aluminium layer inside the container moves downward through the fluid having a higher density to the inside surface of the container. It is then thought that the aluminium, through a diffusion process, passes through the wall of the container to the outer surface of the anode.

It is preferred that the alloy used to make the container have some aluminium in solid solution. It is believed that the aluminium in solid solution in the alloy is the aluminium that diffuses through the container and forms the aluminium oxide protective layer on the outside of the container.

It is preferred that the alloy be near its melting point temperature at the operating temperature of the cell. It has been found that when the alloy is near its melting point temperature during operation that the aluminium in solid solution in the alloy has a high mobility. In other words, the aluminium in solid solution in the alloy readily moves in the alloy thereby readily replenishing the protective layer when needed.

The container is preferably made from Cu—Al, Fe—Al, Ti—Al, Cr—Al, Ni—Al or Cu—Ni—Al alloys but these alloys can also contain further elements such as titanium, yttrium, vanadium, manganese and silicon. It is particularly preferred that the container is made from a binary alloy of aluminium and a metal more noble than aluminium.

The amount of aluminium in solid solution in the alloy used to make the container is suitably about 1% to about 30% by weight alloy. The amount of aluminium in solid solution in the alloy will vary depending on the alloy itself.

Preferably the aluminium in solid solution in the Cu—Al alloy is about 1% by weight to about 15% by weight and more preferably about 10% by weight.

The aluminium in solid solution in the Cu—Ni—Al alloy is preferably between about 1% by weight and about 15% by weight and more preferably about 10% by weight.

The aluminium in solid solution in the Fe—Al alloy is preferably between about 1% by weight and about 30% by weight and more preferably about 21% by weight.

Preferably, the alloy has no aluminium in an intermetallic compound. It is believed that the mobility of aluminium is greatly diminished by an intermetallic compound; thus the formation of the same at any point in the pathway from the inside to the outside of the anode alloy will dramatically decrease the diffusivity of aluminium through the anode.

The refractory layer on the inner wall of the container in the area of the molten aluminium is selected from refractory materials that are resistant against molten aluminium at temperatures up to 1000° C.

The refractory material may either be an electronic insulating material like silicon nitride, silicon carbide, aluminium nitride or aluminium oxide. The refractory material may, however, advantageously be an electronic conductive material such as graphite.

When the refractory material is an electric insulating material, the rate of transfer of aluminium through the anode alloy is controlled by the kinetics of dissolution of elemental aluminium in the molten bath.

When the refractory material is an electronic conductive material the aluminium in the layer of molten aluminium will be at a high chemical potential and at a low chemical potential in the anode alloy. $Al^{3+}$ ions in the fluid bath at the bottom of the anode container can move from the aluminium layer according to the following reactions:

Al (in aluminium layer)→$Al^{3+}$ (in fluid bath)+3e (accumulating) in the aluminium layer, $Al^{3+}$ (at aluminium layer/fluid bath interface)→$Al^{3+}$ (at fluid bath/anode alloy interface) and $Al^{3+}$ (in the fluid bath)+3e (taken from the anode alloy)→Al (dissolved in the anode alloy.

Thus by changing the resistance to electric flow across the electronic conductive refractory material, the rate of transfer of aluminium from the aluminium layer to the anode alloy can be regulated.

The fluid having a density higher than aluminium is preferably a molten salt mixture and comprises salts selected among fluorides, chlorides, cabonates, sulphates and phosphates. Salts comprising fluorides selected among NaF, $AlF_3$, $CaF_2$ and $BaF_2$ are preferred. A particularly preferred composition of the fluid having a density higher than aluminium is about 18% by weight NaF, about 48% by weight of $AlF_3$, about 16% by weight $CaF_2$ and about 18% by weight $BaF_2$. This composition has a density of about 2.6 g/cm$^3$ at the operating temperature of the aluminium electrolysis cell.

Any conventional source of aluminium can be used for the molten aluminium that floats on top of the salt, but it is preferred that the molten aluminium has a purity of about 99% by weight or more and that impurities be incapable of reacting chemically with the fluid below the aluminium layer.

The top of the container is preferably equipped with a sealed cover. The anode further has means for holding the anode and for supplying electric current to the anode all of which are conventional and done is a conventional manner.

The container has side and a bottom wall which has a thickness of about 0.1 cm to about 10 cm and more preferably about 1 cm to about 5 cm.

The thickness of the refractory layer inside the container and the top of the container is about 0.3 to about 5 cm, and more preferably about 0.5 to about 2 cm.

The outside dimensions of the container (anode) may advantageously be such that it can be used in a conventional electrolytic cell so as to replace the current carbon based anodes. Suitably, such carbon based anodes are rectangular-shaped with rounded edges at the bottom. Suitably, the anodes of the present invention are rectangular in shape with rounded bottom edges. The outside dimensions of the container (anode) are, however, not limited to this, but may have any shape and size for use in electrolytic cells having other design than conventional electrolytic cells.

In operation of an electrolytic cell for the production of aluminium equipped with anode according to the invention, a layer of alumina will instantly form on the outside surface of the container that is in contact with the electrolyte in the cell due to reaction of aluminium with oxygen that it produced at the anode. If part of this alumina layer is consumed for some reason, for example due to a low content of alumina in the electrolyte, aluminium in the fluid bath within the container will diffuse through the alloy in the container and will build up a new layer of alumina, or rather repair the already existing layer of alumina, on the outside of the container.

Suitably, the outside surface of the anode that will be in contact with the electrolyte in the electrolytic cell is oxidized in ambient atmosphere at elevated temperature to form an aluminium oxide layer on the outside of the anode before the anode is installed in the electrolytic cell. The temperature during this pre-oxidizing of the anode is preferably about 900-1000° C.

In order to improve the stability of the alumina layer on the anode container the electrolysis should be performed as close as possible to the passivating potential for the anode alloy.

The passivating potential can be defined as the potential where a further increase will lead to a reduction in current passing through the cell. Thus, the passivating potential describes the conditions where the anode is protected by a stable oxide layer where current is still able to pass for this process ($O_2$-evolution).

The normal current density for a carbon based anode in an electrolytic cell used for production of aluminium is about 0.7 to about 1.0 A/cm$^2$. Current density is defined as the amount of current provided to the anode divided by the surface area of the part of the anode that is in contact with the electrolyte. In the present invention, the cell is operated at a current density of about 1 A/cm$^2$ and above. More preferably, the cell is operated at a current density of 2-6 A/cm$^2$ depending on the container alloy.

The molten aluminium and the fluid having dissolved aluminium situated inside the container will be in equilibrium with each other. Aluminium will therefore move from the molten aluminium bath to the fluid below to make up for any aluminium that diffuses through the container alloy. The fluid at the bottom of the container will thus always have the same content of aluminium, no matter how much aluminium diffuses through the container alloy for maintaining the alumina layer on the outside of the alloy.

Except for operating at or near the maximum current density, the electrolytic cell can be operated in a conventional manner using the anode of the present invention.

DETAILED DESCRIPTION OF THE INVENTION

Figure 1:
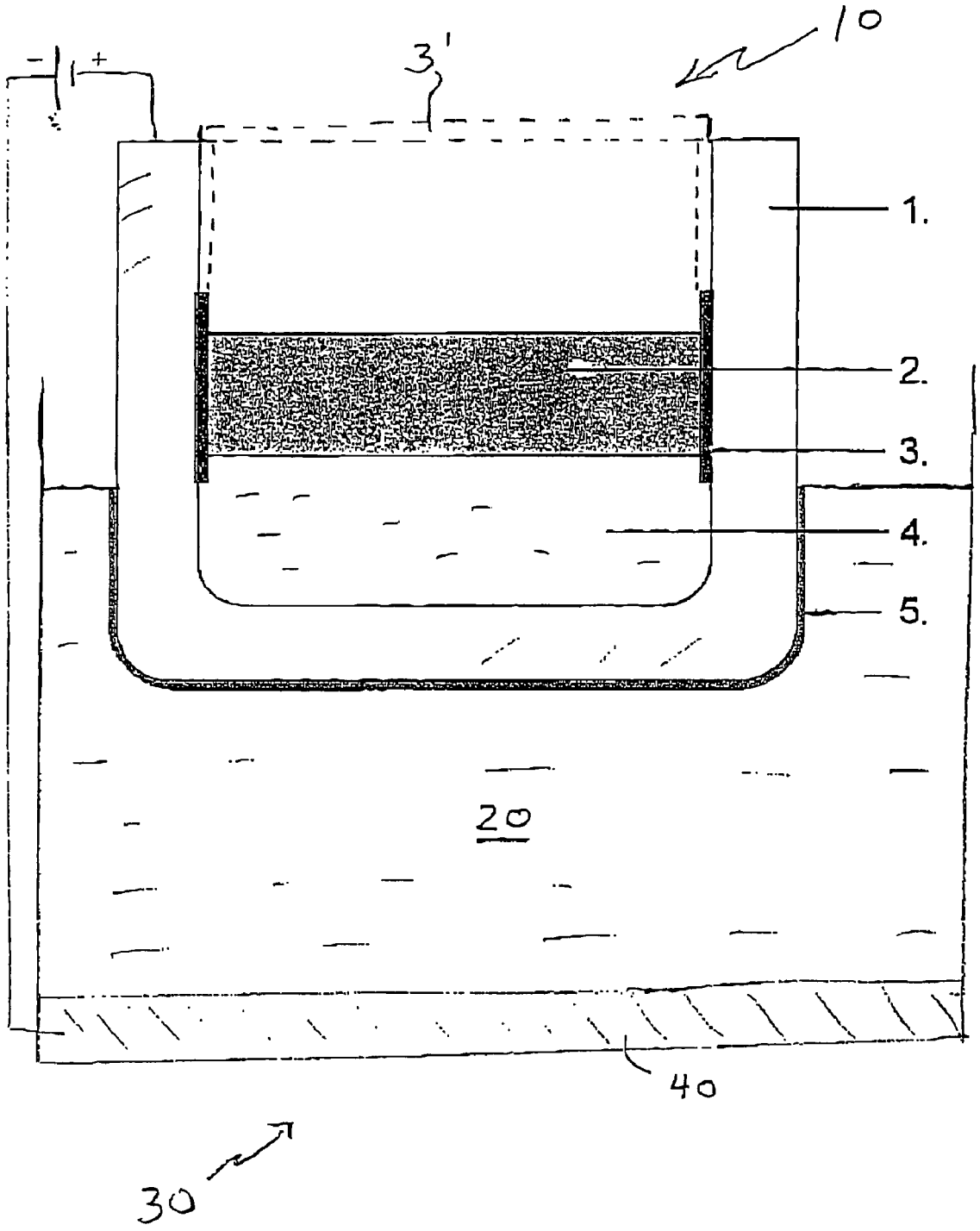
FIG. 1 illustrates an electrolytic cell with an anode in accordance with the present invention.

FIG. 1 shows a vertical cut through an electrolytic cell and anode according to the invention. The anode 10 consists of a container 1 made from an alloy containing aluminium and at least one metal more noble than aluminium. The outside surface of the container 1 is intended to be in contact with molten electrolyte 20 when used in an electrolytic cell 30 for producing aluminium. The aluminium is produced at the cathode 40.

Inside the container 1 there is a fluid 4 having the ability to dissolve aluminium. This fluid 4 is molten at the operating temperature of the electrolytic aluminium cell and has a density higher than aluminium. Preferably the fluid 4 consists of a molten salt mixture containing fluorides. Molten aluminium 2 is floating on the fluid 4. To prevent contact between the molten aluminium bath 2 and the alloy in the container, a refractory lining 3 is arranged at least on the part of the inside container wall in the area of the molten aluminium 2. Preferably, the refractory lining continues to the top of the container 1 and includes a cover as shown by the dashed lines 3'.

When in use a self-repairing aluminium oxide layer 5 will form on the outside surface of the container 1 that is in contact with the electrolyte in the electrolytic aluminium cell.

The oxide layer 5 is repaired by aluminium diffusing from the fluid 4 through the alloy in the container 1 that reacts with oxygen evolved at the anode to form aluminium oxide. When aluminium diffuses into the alloy in the container, the concentration of dissolved aluminium in the fluid 4 will remain unchanged, as aluminium from the molten aluminium 2 will dissolve in the fluid 4.

The anode according to the invention will thus be able to maintain the oxide layer 5 as long as the aluminium bath 2 is not totally consumed. In order to avoid this, additional molten aluminium may at intervals be supplied to the aluminium bath 2 in the container 1.

Figure 2:
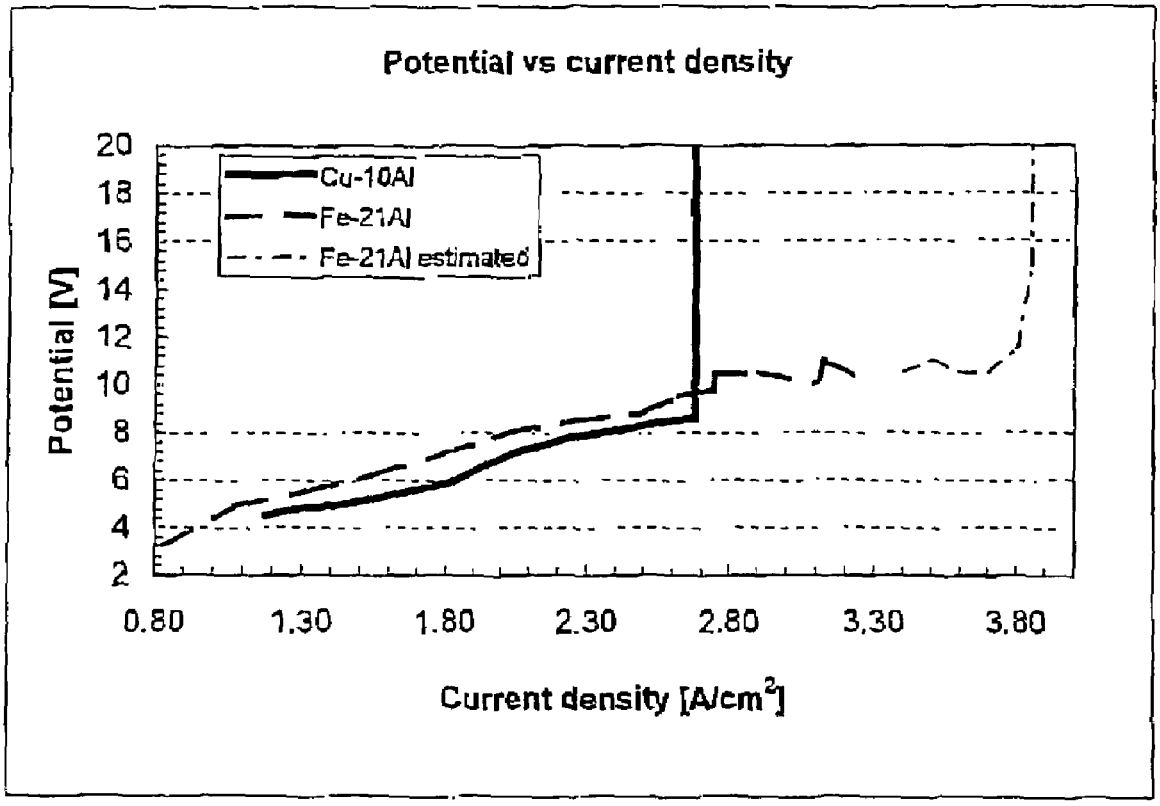
FIG. 2 illustrates a current density diagram for a copper-aluminium alloy anode and for an iron-aluminium alloy.

FIG. 2 illustrates the curve of the potential versus the current density for a Cu—Al 10 weight %, alloy used to make the container. Where the slope of the curve changes from flat to vertical, the maximum current density and the passivating potential is obtained. At this change in the curve, the potential increase exponentially for small increases in current density. This large change for potential and small change for current density is where the electrolytic cell starts to malfunction and one loses control of the cell. This point is defined as the passivating potential or the maximum current density for the alloy.

FIG. 2 also illustrates the curve of the potential versus the current density for a Fe—Al 21 weight %, alloy used to make the container. The passivating potential and maximum current density are shown where the slope of the curve changes from flat to vertical. Only an estimated curve is given for this alloy.

Preferably, the cell is operated close to the maximum current density (passivating potential). Operating the cell under these conditions helps maintain the stability of the protective aluminium oxide layer. Additionally, operating at a high current density increases overall aluminium production for the cell.

EXAMPLE 1

This example illustrates the use of a Cu—Al alloy as the container (anode) and the advantage of operating at a high current density.

Two solid anodes were made of Cu—Al alloy having 10% by weight Al in solid solution. The anode was cylindrical in shape and measured 7 cm in length and had a diameter of 4 cm. Each anode was inserted into a crucible made of carbon and having a cryolite-fluoride bath floating on molten aluminium. The carbon crucible was insulated on the inside with an alsint lining. The molten aluminium layer in the bottom of the carbon crucible acted as a cathode. The bath comprised 76 weight % $Na_3AlF_6$, 11 weight % $AlF_3$, 5 weight % $CaF_2$, and 8 weight % $Al_2O_3$, (saturated).

During operation of this experimental cell, alumina was added to keep the concentration near saturation.

Both anodes were mounted on a stainless steel rod and inserted into the bath to simulate the operating conditions of a cell.

Both anodes were used in the experimental cell where the baths were operated at 965° C. The first experiment was run for 11 hours and the second experiment was run for 7 hours.

In the first experiment, the anode was operated at a current density range from 0.4 to 1.7 A/cm$^2$ and a maximum potential of 7 V. This anode after 11 hours of operation was analyzed and found to have a reaction zone of 1-2 mm thick, a thin layer of aluminium oxide between the reaction zone and the outer surface of the anode, and the aluminium content of the alloy closest to the reaction zone was between 5 and 9 weight %.

In the second experiment, the other anode was operated at a current density range from 1.2 to 2.6 A/cm$^2$ and a maximum potential of 8.5 V. The highest current density was close to the maximum current density for this anode. This anode was analyzed after 7 hours of operation and found to have a reaction zone of about 4 mm thick, a thin layer of aluminium oxide between the reaction zone and the outer surface of the anode, and the aluminium content of the alloy closest to the reaction zone was 11 weight % which is close to the initial aluminium content of the alloy. This means that, for the second experiment, less aluminium in solid solution diffused from the alloy to the protective layer than in the first experiment. This means that the second experiment had a more stable protective layer.

The invention claimed is:

1. A dimensionally stable oxygen-evolving anode for use in an electrolytic cell for the production of aluminium wherein the anode comprises: a container made from an alloy comprising aluminium and at least one metal more noble than aluminium; a fluid bath in the bottom of the container having the ability to dissolve aluminium, said fluid having a density that is higher than the density of molten aluminium at the operating temperature of the electrolytic cell; a pool of molten aluminium in the container floating on top of the fluid bath; and a refractory layer arranged on the inner sidewalls of the container at least in the area of the pool of molten aluminium, said refractory layer protecting the molten aluminium from contacting the inner sidewalls of the container.

2. The anode of claim 1, wherein the container is made from an alloy of Cu—Al, an alloy of Fe—Al, or an alloy of Cu—Ni—Al.

3. The anode of claim 2, wherein the alloy is a Cu—Al alloy having about 1 to 15% by weight aluminium in solid solution in the alloy.

4. The anode of claim 2, wherein the alloy is a Cu—Ni—Al alloy having about 1 to 15% by weight aluminium in solid solution in the alloy.

5. The anode of claim 2, wherein the alloy is a Fe—Al alloy having about 1 to 30% by weight aluminium in solid solution in the alloy.

6. The anode of claim 1, wherein the alloy has no intermetallic phase containing Al.

7. The anode of claim 1, wherein the refractory layer on the inner sidewall of the container in the area of the molten aluminium layer is made from refractory materials that are resistant to chemical attack by molten aluminium up to a temperature of at least 1000° C.

8. The anode of claim 7, wherein the refractory layer is made from an electronic insulating material.

9. The anode of claim 8, wherein the electronic insulating refractory layer is made from silicon carbide, boron nitride, aluminum nitride or aluminium oxide.

10. The anode of claim 7, wherein the refractory layer is made of an electronic conductive material.

11. The anode of claim 10, wherein the refractory layer is made from graphite.

12. The anode of claim 1, wherein the fluid having a density higher than aluminium is a molten salt solution comprising salts having the capacity to dissolve elemental aluminium.

13. The anode of claim 10 wherein the salts are fluorides, chlorides, carbonates, sulphates or phosphates.

14. The anode of claim 13, wherein the salts are $BaF_2$ and one or more of NaF, $AlF_3$, and $CaF_2$.

15. The anode of claim 14, wherein the fluid having a density higher than aluminium contains about 18% by weight of NaF, about 48% by weight $AlF_3$, about 16% by weight $CaF_2$ and about 18% by weight $BaF_2$.

16. A method for operating a dimensionally stable oxygen-evolving anode used in the electrolytic production of aluminium where the anode is a container made from an alloy that allows aluminium to diffuse from inside the container to outside the container, said method comprising:

providing a fluid bath in the bottom of the container, said bath having the ability to dissolve aluminium and said fluid having a density at the operating temperature of the electrolytic cell which is higher than the density of molten aluminium at the operating temperature of the cell; and providing a pool of molten aluminium in said container, on top of said bath.

17. A method for operating a dimensionally stable oxygen-evolving anode in an electrolytic cell for the manufacture of aluminium wherein the anode is in the form of a container and aluminium diffuses from inside the container to outside the container and a source of molten aluminium is provided in the container, said method comprising:

providing electricity to said anode at a maximum current density for said anode.

18. An electrolytic cell for producing aluminium, comprising a cell; a cathode; and a dimensionally stable oxygen-evolving anode comprises: a container made from an alloy comprising aluminium and at least one metal more noble than aluminium; a fluid bath in the bottom of the container having the ability to dissolve aluminium, said fluid having a density at the operating temperature of the electrolytic cell which is higher than the density at molten aluminium at the same temperature; a pool of molten aluminium in the container floating on top of the fluid bath, and a refractory layer arranged on the inner sidewalls of the container at least in the area of the pool of molten aluminium, said refractory layer protecting the molten aluminium from contacting the inner sidewalls of the container.

19. A method for operating an electrolytic cell for producing aluminium, wherein said cell has a dimensionally stable oxygen-evolving anode in the form of a container made from an alloy that allows aluminium to diffuse from inside the container to outside the container, said method comprising:

providing a fluid bath in the bottom of the container, said bath having the ability to dissolve aluminium and said fluid having a density at the operating temperature of the electrolytic cell which is higher than the density of molten aluminium at the operating temperature of the cell; and providing a pool of molten aluminium in said container, on top of said bath.

20. A method for operating an electrolytic cell for producing aluminium, wherein said cell has a dimensionally stable oxygen-evolving anode in the form of a container and aluminium diffuses from inside the container to outside the container and a source of aluminium is provided in the container, said method comprising:

providing electricity to said anode at a maximum current density for said anode.

* * * * *